US005778863A

United States Patent [19]

Oosuka et al.

[11] Patent Number: 5,778,863

[45] Date of Patent: Jul. 14, 1998

[54] IGNITION COIL FOR AN INTERNAL COMBUSTION ENGINE

[75] Inventors: Kazutoyo Oosuka, Gamagori; Masami Kojima, Chiryu; Shozo Ikezima, Okazaki, all of Japan

[73] Assignee: Nipponenso Co., Ltd., Kariya, Japan

[21] Appl. No.: 567,707

[22] Filed: Dec. 5, 1995

[30] Foreign Application Priority Data

Dec. 6, 1994 [JP] Japan ..... 6-302298
Sep. 18, 1995 [JP] Japan ..... 7-238573

[51] Int. Cl.[6] ..... F02P 13/00; H01F 27/12

[52] U.S. Cl. ..... 123/634; 336/58; 336/94

[58] Field of Search ..... 123/634, 635; 336/58, 94

[56] References Cited

U.S. PATENT DOCUMENTS 4,033,854 7/1977 Ohmori et al. ..... 208/14
4,238,343 12/1980 Pellegrini, Jr. ..... 585/24
4,617,907 10/1986 Johansson et al. ..... 123/647
4,621,881 11/1986 Johansson et al. ..... 339/26
4,706,638 11/1987 Johansson et al. ..... 123/647
5,632,259 5/1997 Konda et al. ..... 123/634

*Primary Examiner*—Tony M. Argenbright
*Assistant Examiner*—Hieu T. Vo
*Attorney, Agent, or Firm*—Cushman Darby & Cushman IP Group of Pillsbury Madison & Sutro LLP

[57] ABSTRACT

To provide an ignition coil for an internal combustion engine which improves high-voltage sealing performance and moreover reduces housing outer diameter, an ignition coil for an internal combustion engine is made up of a transformer portion of cylindrical configuration housed within a housing chamber of a case, a control-circuit portion which is positioned on one end portion of this transformer portion and causes primary current of the transformer portion to be intermittent, and a connecting portion which is positioned on another end portion of the transformer portion and supplies secondary voltage of the transformer portion to a spark plug. The interior of the housing chamber is filled with insulating oil which has a flash point of 180° C. or more, a total acid number of oxidation stability of 0.6 mgKOH/g or less, a pour point of −20° C. or less with no cloudiness occurring before that temperature is reached, and a kinematic viscosity of not less than 20 cSt and not more than 180 cSt at 40° C.

20 Claims, 3 Drawing Sheets

IGNITION COIL FOR AN INTERNAL COMBUSTION ENGINE

BACKGROUND OF THE INVENTION

1. Field of the Invention

The present invention relates to an ignition coil for an internal combustion engine, and more particularly, to an ignition coil for an internal combustion engine where the ignition coil encases high-voltage insulating oil and is directly installable in an internal combustion engine.

2. Description of the Related Art

Various configurations of ignition coils employed in an internal combustion engine have been proposed to achieve compactness and light weight. In particular, a device employing insulation material of insulating oil, epoxy resin, or the like to ensure insulation against high voltage is known.

An ignition coil for an internal combustion engine which is installed directly on an engine and is directly coupled with spark plugs is disclosed in, for example, Japanese Patent Application PCT Laid-Open No. Sho. 60-501961 and Japanese Unexamined Patent Publication No. Hei. 5-3719, and moreover employment of insulation oil-is disclosed.

Meanwhile, high output and high efficiency which are greater than at present are demanded of engines for automobiles and the like, the cylinder-head portions of engines are increasing in complexity because of adoption of more valves and improvements in combustion-chamber configuration, and it has become difficult to obtain a large space for installation of the ignition coil. In the case of a DOHC engine in particular, increasingly narrower valve parting angles are being attempted, and the state is such that installation of a thick ignition coil is extremely difficult, and dimensions which are housable within for example a plug hole are demanded.

With the ignition coils disclosed in Japanese Patent Application PCT Laid-Open No. 60-501961 and Japanese Unexamined Patent Publication No. 5-3719, the diameter of the ignition coil is thick, and engines where such ignition coils are housable are limited. Additionally, there was a need to specially design an engine for ignition-coil installation.

Moreover, because the ignition coil is placed in the high-temperature environment immediately proximately to the engine body according to the foregoing prior art, there was a need to heighten safety at a time of insulation-oil leakage.

Furthermore, because the ignition coil is placed in the high-temperature environment immediately proximately to the engine body according to the foregoing prior art, there was a problem in which the insulating oil is susceptible to degradation. In particular, the interior of the case is filled completely with insulating oil according to the foregoing prior art, but in a case where a gas chamber is provided within the case to absorb volume changes due to temperature change and moreover the gas is an oxidizing gas such as air, there was the problem whereby high-voltage durability declines due to oxidation and degradation of the insulating oil.

Additionally, because the ignition coil is directly fixed to the engine, there was the problem in which air bubbles are intermixed in the insulating oil due to vibration of the engine, and insulation performance declined due to these air bubbles.

SUMMARY OF THE INVENTION

To solve problems of the prior art such as the foregoing, it is an object of the present invention to provide an improved ignition coil for an internal combustion engine.

More particularly, it is an object of the present invention to provide an ignition coil for an internal combustion engine which is housed within a plug hole of an engine and can be mounted directly on the engine, which demonstrates high safety even at a time of leakage of insulating oil, and which stably maintains insulation performance against high voltage even with respect to engine heat and vibration.

In this way, burning of insulation oil employed in the ignition coil is avoided even when the internal combustion engine has overheated. Moreover, oxidation and degradation of the insulation oil in a high-temperature environment are suppressed. Meanwhile, even when at low temperature, the insulating oil has sufficient fluidity and can maintain insulation performance even when at low temperature. Furthermore, because intermixing of air bubbles into the insulating oil is suppressed even in a vibrating environment while the insulating oil maintains appropriate fluidity, work performance is superior when immersing the coil portion in the insulating oil, and decline in insulation performance is also suppressed.

Additionally, burning of the insulating oil at a time of high temperature such as during overheating can be avoided more reliably thereby.

Furthermore, oxidation and degradation of the insulating oil are prevented more reliably thereby, and oxidation and degradation of the insulating oil are suppressed and insulation performance can be maintained over a long period particularly in a case where insulating oil is enclosed along with air within the case.

Moreover, the insulating oil has sufficient fluidity and can maintain insulation performance not only in an ordinary usage environment, but even when at extremely low temperature.

In addition, intermixing of air bubbles in a vibrating environment is prevented more reliably and direct fixing even to an internal combustion engine with severe vibration becomes possible thereby.

Additionally, appropriate fluidity of the insulating oil is obtained thereby. For this reason, an ignition coil for an internal combustion engine with superior work performance during immersed disposal of the coil in insulating oil can be provided.

Furthermore, mounting on an internal combustion engine is facilitated. Moreover, volume change accompanying temperature change can be absorbed by an air chamber which can be provided at low cost.

Other objects and features of the invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

The preferred embodiments of the present invention are hereinafter described with reference to the accompanying drawings.

Figure 1:
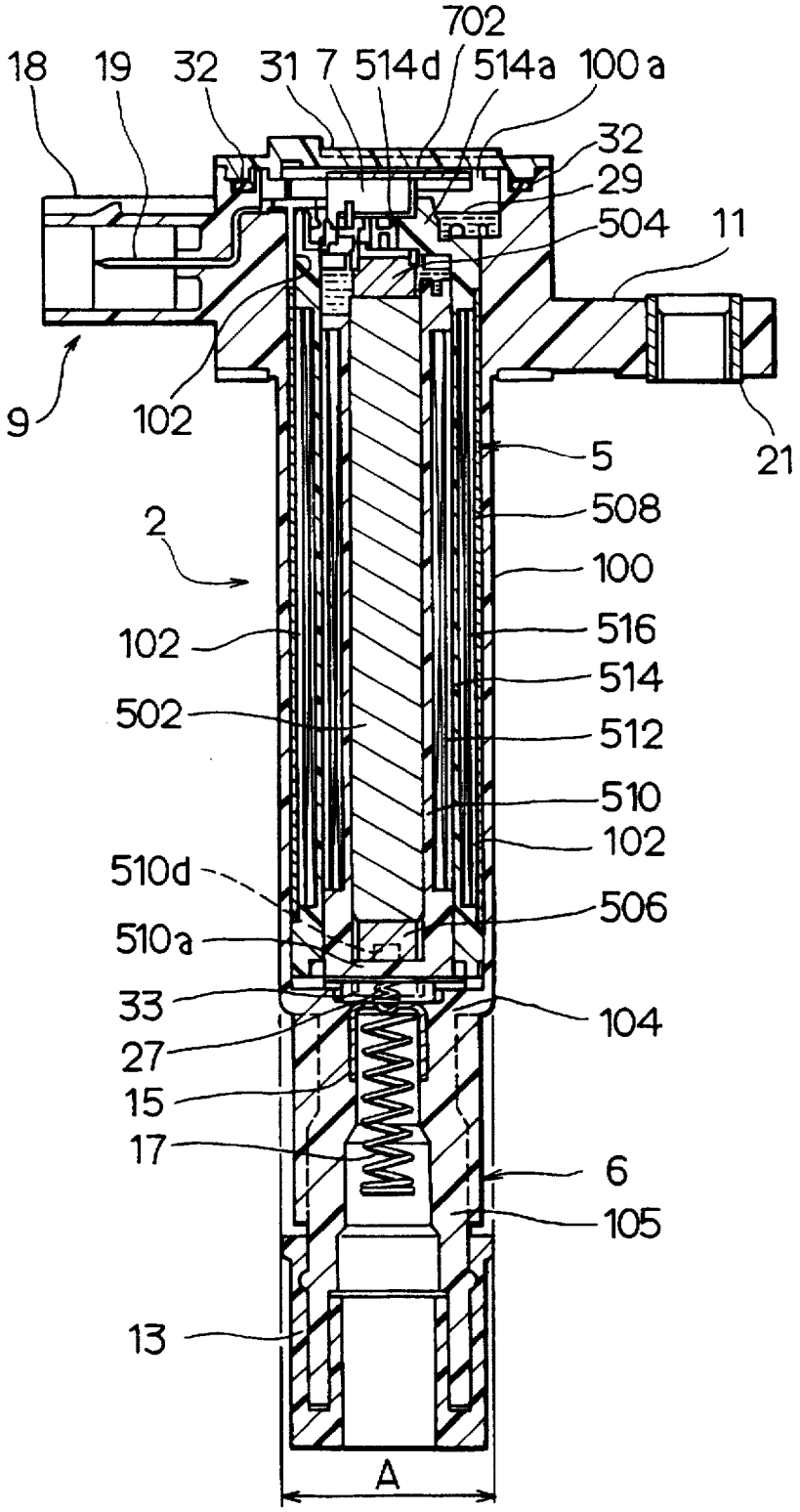
FIG. 1 is a longitudinal sectional view of an ignition coil for an internal combustion engine according to an embodiment of the present invention.

As shown in FIG. 1, an ignition coil for an internal combustion engine 2 is provided with a case 100 of bottomed-tube configuration composed of resin material as a housing of the ignition coil. A transformer portion 5 and a control-circuit portion 7 as a coil portion for high-voltage generation are inserted in a housing chamber 102 formed in an inner side of this case 100 from an opening at an upper side thereof and are housed within. Furthermore, insulating oil 29 is filled within the housing chamber 102, allowing a slight gas portion to remain, and the transformer portion 5 is immersed substantially completely in the insulating oil 29. It is essential that the insulating oil 29 be filled so that a gas chamber is formed and gas is allowed to remain within the housing chamber 102 to absorb volume change accompanying temperature change. According to this embodiment, it is assumed that work is carried out in an atmospheric environment to perform assembly operations inexpensively, and air is allowed to remain as the gas. The control-circuit portion 7 is housed in an upper portion which is one end of the case 100, and responds to instruction signals from an external circuit (not shown) to cause primary current of the transformer portion 5 to be intermittent. A connecting portion 6 which supplies secondary voltage inducted from the transformer portion 5 is provided in a lower portion which is another end of the case 100.

A connector for control-signal input use 9 and a bracket for fixing use 11 are disposed protrudingly in the radial direction of the case on the upper portion of the case 100. The connector for control-signal input use 9 is made up of a connector housing 18 and connector pins 19. The connector housing 18 is formed integrally with the case 100, and three connector pins 19 are positioned within this connector housing 18. The connector pins 19 pass through the case 100 and are connected in series to the control-circuit portion 7 and a primary coil and secondary coil of the transformer portion 5. The bracket for fixing use 11 is formed integrally with the case 100, and a collar made of metal is insertion-molded.

A tube portion 105 which opens downwardly is formed on the connecting portion 6 formed at the bottom portion of the case 100. A rubber plug cap 13 is fitted on an open-end rim of this tube portion 105. A wall 104 is formed integrally with the case 100 between the tube portion 105 and the housing chamber 102 as a bottom for the two spaces. A cap 15 made of metal as conductive material is insertion-molded in the resin material of the case 100 in this wall. This cap 105 partitions the housing chamber 102 and the connecting portion 6 in an electrically conductive yet liquid-tight fashion. A coil spring 17 as conductive material is retained on an inner bottom of the cap 15.

An open portion 100*a* is formed on an upper side of the case 100 to allow the transformer portion 5, control-circuit portion 7, insulating oil 29, and the like to be housed in the housing chamber 102 from outside the case 100. This open portion 100*a* is closed liquid-tightly by a cover 31 made of resin and an O-ring 32.

An iron core 502 of the transformer portion 5 is formed by laminating thin silicon-steel plates of differing widths so that a cross section thereof becomes substantially circular. Magnets 504 and 506 having polarity of reversed directions of magnetic flux generated by excitation by the coil are disposed respectively on both ends of this iron core 502.

A secondary spool 510 which is a molded-resin component is formed in a bottomed-tube configuration having a collar portion at both ends, and a bottom end is substantially closed by a bottom portion 510*a*. The iron core 502 and magnet 506 are housed in the interior of this secondary spool 510, and a secondary coil 512 is wound around an outer periphery of the secondary spool 510.

A terminal plate 33 electrically connected to one end of the secondary coil 512 is fixed to the bottom portion 510a, and a spring 27 for contacting the cap 15 is fixed to this terminal plate 33. This terminal plate 15 and spring 27 function as a spool-side conductive material, and high voltage inducted from the secondary coil 516 is supplied via the preventive maintenance plate 33, spring 27, cap 15, and spring 17 to the electrode portion of a spark plug (not shown).

A primary spool 514 which is a molded-resin component is formed in a bottomed-tube configuration having a collar portion at both ends, and a bottom end is substantially closed by a cover portion 514*a*. A primary coil 516 is wound around an outer periphery of this primary spool 514.

The primary spool 514 is disposed to cover the secondary coil 516 wound on the secondary spool 510. For this reason, the iron core 502 provided with the magnets 504 and 506 at both ends is squeezed between the cover portion 514*a* of the secondary spool 510 and the bottom portion 510*a* of the primary spool 514.

A plurality of terminals to which both ends of the primary coil 516 and one end of the secondary coil 512 are connected is maintained on the cover portion 514*a* of the primary spool 514. The connector pins 19 of the connector 9 and the control-circuit portion 7 are connected to this plurality of terminals. Three leads are drawn from the control-circuit portion 7 maintained on an upper side of the cover portion 514*a*, and these leads are soldered to the connector pins 19 and the plurality of terminals.

The control-circuit portion 7 is made up of a molded-resin switching element which causes conduction current to the primary coil to be intermittent, and a control circuit which is an igniter that generates the control signals of this switching element. Additionally, a heat sink 702 which is a separate body is glued to the control-circuit portion 7 for heat radiation of circuit elements such as the switching element.

An auxiliary core 508 is mounted further on the outer side of the primary spool 514. This auxiliary core 508 winds a thin silicon-steel plate in tubular configuration, forms a gap axially by not connecting the winding starting end and the winding terminating end, and has an axial length which extends from an outer peripheral position of the magnet 504 to an outer peripheral position of the magnet 506.

The interior of the housing chamber 102 in which the transformer portion 5 and the like are housed is filled with the insulating oil 29, allowing a slight air space to remain at an upper-end portion of the housing chamber 102. The insulating oil 29 penetrates via a lower-side open end of the primary spool 514, an opening 514*d* formed in a substantially central portion of the upper cover portion 514*a* of the primary spool 514, an upper-side open end of the secondary spool 510, and an opening 510*d* formed in a lower outer peripheral wall of the secondary spool 510, and causes electrical insulation between the iron core 502, secondary coil 512, primary coil 516, auxiliary core 508, and the like to be reliable.

Figure 2:
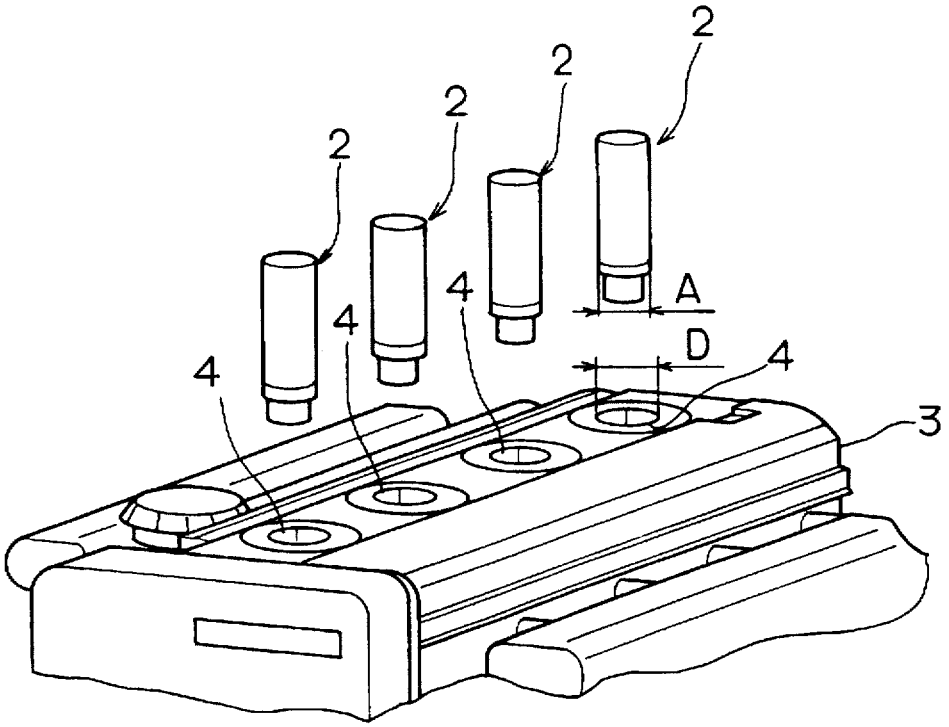
FIG. 2 is a perspective view indicating an ignition coil for an internal combustion engine according to an embodiment of the present invention and a plug hole of an engine cover.

The above-described ignition coil is inserted in a plug hole of an internal combustion engine as indicated typically in FIG. 2, and is fixed to an engine head 3 by a bolt (not shown) provided through a collar 21. A spark plug mounted on a bottom portion of the plug hole is received within the connecting portion 6, and a head-portion electrode of the spark plug electrically contacts an end portion of the spring 17.

It is essential that this ignition coil have a cross-sectional configuration and dimensions which are housable within the plug hole, as shown in FIG. 2, and 30 mm or less is required. According to this embodiment, a tube-portion cross section of the case 100 is formed to be circular so that an inner-diameter dimension D accommodates a plug hole of 24 mm, and an outer diameter A thereof is established to be 23 mm.

In such an ignition coil, gaps and distances between components which make up the transformer portion 5 become smaller to house the transformer portion 5 within the narrow housing chamber 102. In a case where hard insulating resin was disposed between the components, therefore, there was susceptibility to cracking and a chance of occurrence of defective insulation due to thinness thereof. In contrast to this, insulating oil 29 is utilized according to the foregoing embodiment, and so occurrence of defective insulation is prevented even with long-term usage.

An oil which satisfies several conditions (1) through (4) indicated hereinafter is used for this insulating oil 29. "JIS" refers to "Japan Industrial Standards," and the "flash point," "total acid number," "pour point," and "kinematic viscosity" as discussed here and in the claims can be defined respectively as "open-type flash point according to JISC2101 11. (Flash-point testing), " "total acid number of oxidation stability according to JISC2101 18. (Oxidation-stability testing)," "pour point according to JISC2101 9. (Pour-point testing)," and "kinematic viscosity according to JISC2101 8. (Kinematic-viscosity testing)." Kinematic viscosity is the value at 40° C.

(1) Open-type flash point according to JISC2101 11. (Flash-point testing) is required to be 180° C. or more, with 200° C. or more preferred. This flash point is established under the hypothesis that temperature within a plug hole 4 reaches approximately 150° C. to 180° C. during overheating of the internal combustion engine, and 180° C. or more is demanded, with 200° C. or more preferred.

(2) Total acid number of oxidation stability according to JISC2101 18. (Oxidation-stability testing) is required to be 0.6 mgKOH/g or less, with 0.2 mgKOH/g or less preferred, and 0.1 mgKOH/g or less still more preferred. When total acid number exceeds 0.6 mgKOH/g, for example in a case where high-voltage durability testing is performed for a predetermined time, deterioration occurs in the oil accompanying generation of oxide-component sediments and the like, and so there is a chance of the volume-resistance ratio declining and insulation-destruction voltage declining markedly. Additionally, insulating oil where the total acid number is 0.2 mgKOH/g or less generates substantially no oxide-component sediments and the like even when high-voltage durability testing is performed for a predetermined time, and deterioration of insulation characteristics is substantially unobserved. In particular, it is essential to employ oil with superior oxidation stability against air in a case where an air chamber is disposed within the housing chamber 102 as with the above-described ignition coil 2. Importance of the oxidation stability of the insulating oil is reduced by replacing the gas within the air chamber with a non-oxidizing gas such as nitrogen, but employment of insulating oil with superior oxidation stability is preferred, and performance of the determined period can be maintained over a long period.

(3) Pour point according to JISC2101 9. (Pour-point testing) is required to be −20° C. or less with no cloudiness occurring before this temperature is reached, with −40° C. or less with no cloudiness occurring before this temperature is reached being preferred. The condition of −20° C. is a lower limit of operating-environment temperature for general automotive equipment, and when the pour point exceeds −20° C. there is a chance of coagulation of the insulating oil and exertion of a negative effect on high-voltage insulating characteristics. Additionally, −40° C. is hypothesized as an operating environment of greater severity, and so it is preferred that fluidity of the insulating oil be ensured at this temperature as well. Through this, ignition operation with no occurrence of insulation destruction can be performed even what at low temperature.

(4) Kinematic viscosity at 40° C. according to JISC2101 8. (Kinematic-viscosity testing) is required to be 180 cSt or less, with 130 cSt or less preferred. When kinematic viscosity exceeds 180 cSt, there is a chance of a negative effect being exerted on work performance when filling the oil, or of convection of the insulating oil deteriorating and a negative effect being exerted on heat-radiating action. Permeability of the insulating oil during immersion of the transformer portion 5 is favorable by establishing kinematic viscosity to be 180 cSt or less. Furthermore, insulating oil with a kinematic viscosity of 130 cSt is preferred from the standpoint of work efficiency. Meanwhile, it is demanded that kinematic viscosity be 20 cSt or more, with 50 cSt preferred and 100 cSt still more preferred. With vibration acceleration of the internal combustion engine hypothesized to be approximately 25 G, a lower limit of kinematic viscosity is taken to be at least 20 cSt or more to suppress generation of air bubbles while vibration is applied to the insulating oil in this way, with 50 cSt or more preferred, and is taken to be 100 cSt or more to reliably prevent generation of air bubbles and air-bubble flow. Consequently, a range of kinematic viscosity of not less than 20 cSt and not more than 180 cSt is demanded, with not less than 50 cSt and not more than 180 cSt preferred and not less than 100 cSt and not more than 180 cSt still more preferred. Moreover, in a case where work performance is given priority, the respective upper limits of the foregoing ranges are taken to be 130 cSt. Additionally, for kinematic viscosity the value in a room-temperature environment is essential from the standpoint of work performance, but the value under high temperature corresponding to a state of installation on an internal combustion engine is essential for effectiveness in preventing air-bubble generation. Herein, because kinematic viscosity when at room temperature and kinematic viscosity when at high temperature are correlated, a range in which the characteristics of the present invention are obtained by kinematic viscosity at 40° C., which is proximate to room temperature, is taken to be specified. Moreover, kinematic viscosity at 100° C. is demanded to be 4 cSt, and preferably 10 or more is preferred, as will be seen in an embodiment which will be described later.

The reason that these several conditions (1) through (4) are demanded of the insulating oil 29 is to provide an ignition coil for an internal combustion engine 2 which can enhance high-voltage sealing performance of the oil 29, together with not requiring replacement of the insulating oil 29 in practical use by maintaining a predetermined high-voltage insulation characteristic over a long period.

Insulating oil which satisfies the several conditions in this way can be selected from among mineral oils of the paraffinic series, naphthenic series, or the like, or synthetic oils such as alkylbenzenes, polyolefin oils, or ester oils, or moreover blended oils thereof. For example, some paraffinic mineral oil, some alkylbenzenes, some polyolefin oils, some ester oils, or blended oils thereof and the like are acceptable. Furthermore, addition of additives is not preferred from the standpoint of insulation characteristics, but combined use of minute quantities of additives such as pour-point depressants, antioxidants, or the like at an extent which does not detract from the insulation characteristics of the insulating oil is acceptable.

Next, TABLE 1 indicates characteristic values of oil types of first and second embodiments as specific embodiments of insulating oil 29 which fulfill the above-described characteristics. First and second comparative examples are also indicated as comparative examples in TABLE 1.

As is understood from this table, the paraffinic mineral oils of the first and second embodiments are improved in comparison with the naphthenic mineral oils of the respective first and second comparative examples in points which will be stated hereinafter.

TABLE I

| | 1st Emb. Para. Min. Oil | 2nd Emb. Para. Min. Oil | 1st Com. Ex. Naphth. Min. Oil | 2nd Com. Ex. Naphth. Min. Oil |
|---|---|---|---|---|
| Flash Point (Open Type) (°C.) | 208 | 276 | 160 | 165 |
| Pour Point (°C.) | −45 | −27.5 | −35 | −35 |
| Kinematic Visc. (cSt [40° C.]) | 28.3 | 155 | 11.2 | 12.4 |
| (cSt [100° C.]) | 4.8 | 14 | 3.4 | — |
| Ox. Stability Total Acid Number After 75 Hours @ 120° C. (mg KOH/g) | 0.1 | 0.1 | 0.3 | 0.4 |
| Specific Gravity | 0.87 | 0.89 | 0.87 | 0.89 |
| Dielectric Strength (kV) | 75 | 70 | ≧70 | ≧70 |
| Water Cont. (ppm) | ≦30 | ≦30 | 11 | — |

The flash points of the first and second embodiments are established approximately 50° C. higher in comparison with the flash points of the first and second comparative examples, reaching 200° C. or more. Burning of the insulating oil 29 can thereby be avoided more reliably, even when an accident in which the insulating oil 29 of the ignition coil 2 occurs during overheating of the internal combustion engine.

The pour point of the oil of the first embodiment is established approximately 10° C. lower in comparison with the pour points of the first and second comparative examples. Consequently, high-voltage insulation characteristics can be maintained with no coagulation of the insulating oil even in a usage state of −20° C. or −40° C. Because the pour point of the second embodiment is −20° C. or less, high-voltage insulation characteristics can be maintained with no coagulation of the insulating oil even in general low-temperature conditions.

The kinematic viscosity of the first and second comparative examples is only approximately 10 degrees at 40° C., and drops to 3 degrees at 100° C. For this reason, a phenomenon was observed in which air bubbles invaded the insulating oils of these comparative examples due to vibration of the internal combustion engine, and moreover these air bubbles penetrated to a deep portion of the ignition coil. There is a chance that such an invasion of air bubbles may become a cause of occurrence of localized low withstand-voltage areas. In contrast to this, the kinematic viscosity of the first embodiment is a high 28.3 cSt at 40° C., and 4.8 cSt is maintained even at 100° C. When the insulating oil of this first embodiment was poured into the ignition coil and installed directly on an internal combustion engine, slight occurrence of air bubbles and penetration of air bubbles to deep portions was observed. However, penetration of air bubbles to an extent which leads to a decline in insulation performance was not observed in experimentation. Meanwhile, kinematic viscosity of the second embodiment was maintained at even higher values of 155 cSt at 40° C. and 14 cSt even at 100° C. In a case where the insulating oil of this second embodiment was poured into the ignition coil and directly fitted on an internal combustion engine, occurrence of air bubbles was considerably suppressed in comparison with the first embodiment, and substantially no penetration of air bubbles into a deep portion was observed.

Total acid numbers of oxidation stability of the insulating oils of the first and second embodiments are approximately 0.1, which is markedly lower in comparison the total acid numbers of the insulating oils of the first and second comparative examples. Consequently, deterioration of insulation characteristics can be greatly suppressed with substantially no generation of oxide-component sediments and the like even when high-voltage durability testing is performed for a predetermined time. For this reason, high-voltage insulation characteristics can be maintained over a long period even when an air chamber is provided within the housing chamber 102.

High-voltage durability testing which compares insulation characteristics in a case where thermosetting resin is employed as the insulating material filled in the ignition coil and a case where insulating oil which fulfills the several conditions of the present invention will be described hereinafter. A typical epoxy resin was employed as the thermosetting resin, and a paraffinic mineral oil was employed as the insulating oil.

Figure 3:
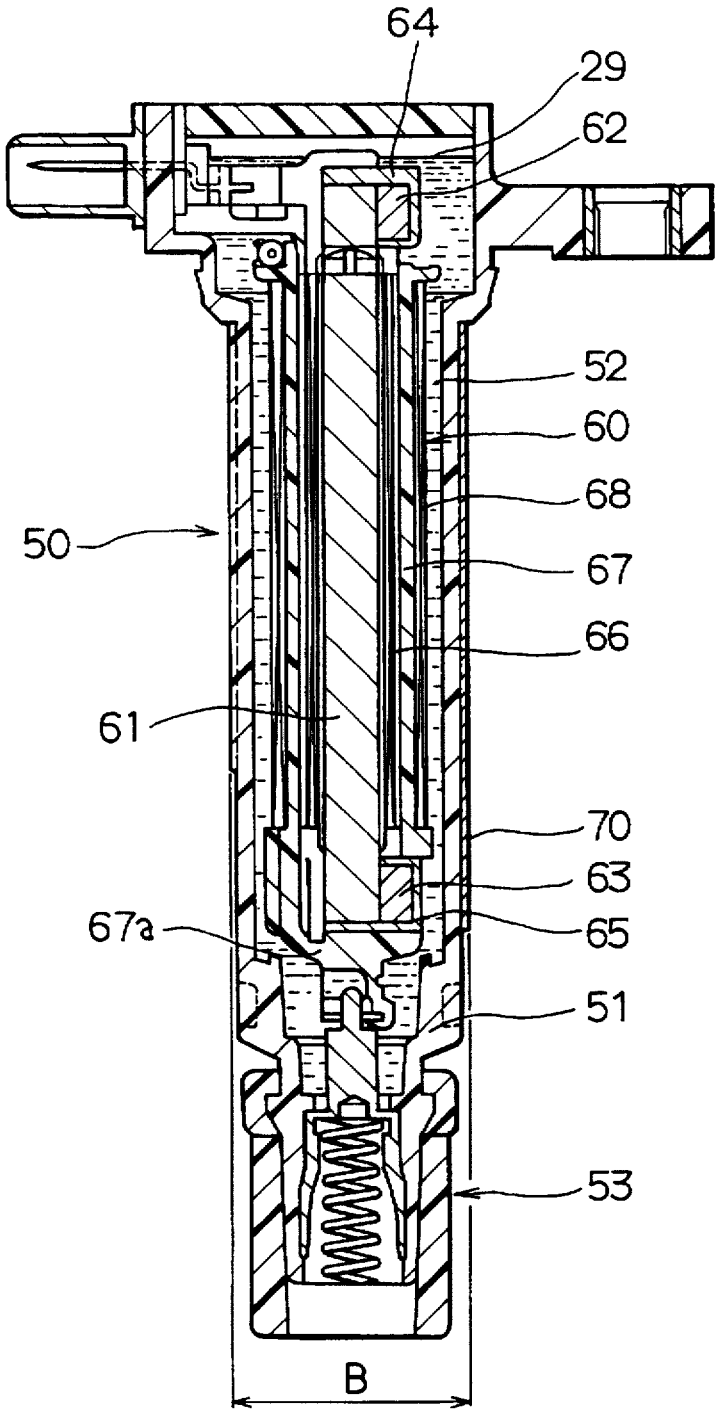
FIG. 3 is a longitudinal sectional view of an ignition coil for an internal combustion engine according to an embodiment of the present invention.

Herein, before describing the results of this high-voltage durability testing, an ignition coil for an internal combustion engine 50 will be described with reference to FIG. 3.

The ignition coil for an internal combustion engine 50 is primarily made up of a transformer portion 60, a control-circuit portion (not shown), and a connecting portion 53, and the structure of the transformer portion 60 as well as an outer diameter B of a case 51 which covers a perimeter of this transformer portion 60 differ from the ignition coil for an internal combustion engine 2 indicated in FIG. 1.

A housing chamber 52 is formed in an inner side of the case 51 of circular configuration made of resin. The outer diameter B of this case is established to be 25 mm.

The transformer portion 60 housed within the housing chamber 52 is made up of an iron core 61 which forms an open magnetic-circuit structure, magnets 62 and 63, a primary spool (not shown), a primary coil 66, a secondary spool 67, and a secondary coil 68.

The iron core 61 of substantially cylindrical configuration is assembled from overlapping thin silicon-steel plates. The magnets 62 and 63 having polarity of reversed directions of magnetic flux generated by excitation by the coil are respectively mounted by magnet-fixing portions 64 and 65 on side walls proximate to both end portions of this iron core 61. These magnets 62 and 63 are made up on a combination of three magnets composed of a square-cylindrical configuration.

The primary coil 66 is wound around an outer periphery of the primary spool installed on an outer periphery of the iron core 61. The secondary spool 67 is disposed to cover the primary coil 66 which is wound on the primary spool.

An open portion is formed in one end portion of this secondary spool 67, and an end portion of the iron core 61 protrudes from this open portion. Additionally, a bottom portion 67*a* is formed on one end portion of the secondary spool 67, and the magnet-fixing portion 65 is squeezed between this bottom portion 67*a* and the end portion of the iron core 61.

The secondary coil 68 is wound around an external periphery of a secondary spool 510 to cover the primary spool positioned on an inner side of the secondary coil 68 and the primary coil 66 wound on the primary spool.

Insulating material 29 is filled in gaps formed respectively between the iron core 61, primary coil 66, secondary coil 68, inner walls of the case 51, and the like, and sealing of high voltage generated from the secondary coil 68 is performed by this insulating oil 29.

An auxiliary core 70 of tubular configuration is installed on an outer peripheral wall of the case 51, and leakage of magnetic flux generated from the iron core 61, primary coil 66, and secondary coil 68 is suppressed by this auxiliary core 70.

Figure 4:
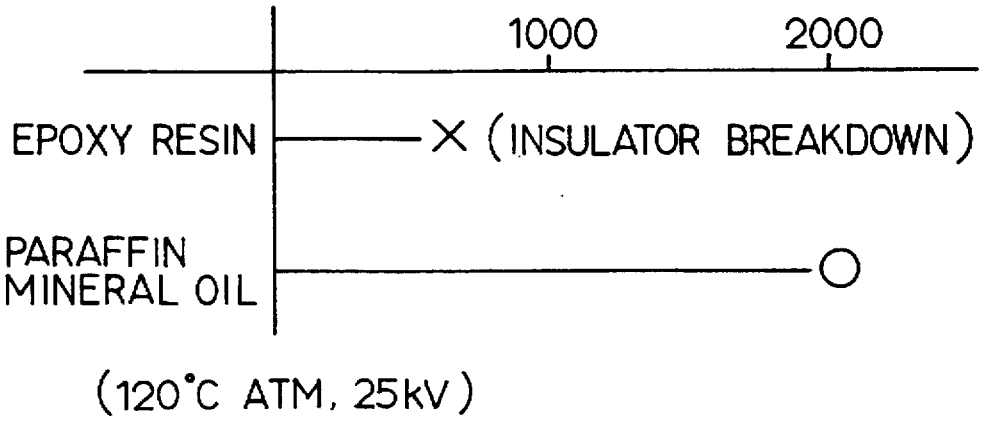
FIG. 4 is a diagram indicating results of high-voltage durability testing of insulating oil according to an embodiment of the present invention and epoxy resin of a comparative example.

FIG. 4 indicates the results of high-voltage durability testing which compared insulating characteristics in a case where epoxy resin was filled as the insulating material 29 of the ignition coil for an internal combustion engine 50 made up of this structure, and a case where paraffin mineral oil was filled. This high-voltage durability testing continuously generated 25 kV at the secondary coil 66 of the ignition coil for an internal combustion engine 50 in an ambience of 120° C., and confirmed whether insulation destruction occurred between primary coil 66, secondary coil 68, automatic core 70, and the like.

As shown in FIG. 4, according to this high-voltage durability testing, insulation destruction occurred between the secondary coil 68 and the auxiliary core 70 prior to reaching a continuous 1,000 hours in the case of filling with epoxy resin, whereas it was confirmed that no insulation destruction occurred between the primary coil 66, secondary coil 68, auxiliary core 70, or the like in the case of filling with paraffinic mineral oil, even when a high-voltage generation time of a continuous 2,000 hours was exceeded.

According to the ignition coil for an internal combustion engine 50 filled with epoxy resin, when the epoxy resin sets, mechanical warpage occurs within the epoxy resin due to filler mixed in the epoxy resin, and so it is believed that an area of small insulation durability was produced due to this mechanical warpage, and insulation destruction occurred thereat. Additionally, it is believed that corona discharge occurred at gaps of boundary surfaces produced at places where the epoxy resin did not adhere to the surfaces of the secondary spool 67, secondary coil 68, and the like, producing insulation destruction.

In contrast to this, according to the ignition coil for an internal combustion engine 50 filled with paraffinic mineral oil, because distribution of heat received from the internal combustion engine body differs according to the location of the ignition coil for an internal combustion engine 50, the insulating oil 29 with which the interior of the housing chamber 52 is filled performs convection, and so insulating oil 29 which has deteriorated due to coronal discharge or the like does not remain in one place. It is believed that the device consequently withstood high-voltage durability testing over 2,000 hours.

This improved effect in insulation durability is an effect obtained by utilizing insulating oil, but because insulating oil was employed to fulfill conditions of flash point, pour point, total acid number, kinematic viscosity, and the like specified by the present invention, requirements of stability in a high-temperature environment, reliable operation in a low-temperature environment, stabilized insulating performance over a long period, and stabilized insulating performance in a vibrating environment can be satisfied.

According to the present invention, high-voltage sealing performance of an ignition coil for an internal combustion engine 2 or 50 can be improved by filling the ignition coil for an internal combustion engine 2 or 50 with insulating oil 29 which fulfills the above-described several conditions (1) through (4). Thereby, case outer diameter of the ignition coil for an internal combustion engine 2 or 50 can be established to be 30 mm or less, and the ignition coil for an internal combustion engine 2 or 50 can be housed within a plug hole. Additionally, because case outer diameter of the ignition coil for an internal combustion engine 2 or 50 can be narrower than an ignition coil for an internal combustion engine according to the prior art, volume of the ignition coil for an internal combustion engine 2 or 50 can be reduced with respect to an ignition coil for an internal combustion engine according to the prior art which utilizes thermosetting resin as insulating material, and the weight of the ignition coil for an internal combustion engine 2 or 50 is reduced.

Moreover, according to the present invention, because outer diameter B of the case 51 of the ignition coil for an internal combustion engine 50 is established to be larger than outer diameter A of the case 100 of the ignition coil for an internal combustion engine 2, insulation clearance between the primary coil 66 and the secondary coil 68 can be widened. High-voltage durability of the ignition coil for an internal combustion engine 50 is thereby improved over high-voltage durability of the ignition coil for an internal combustion engine 2.

Furthermore, according to the present invention, because outer diameter B of the case 51 of the ignition coil for an internal combustion engine 50 is established to be larger than outer diameter A of the case 100 of the ignition coil for an internal combustion engine 2, the number of windings of the secondary coil 68 housed in the housing chamber 52 can be increased over the number of windings of the secondary coil 512 of the ignition coil for an internal combustion engine 2. Secondary voltage generated from the secondary coil 68 of the ignition coil for an internal combustion engine 50 can thereby be increased.

Additionally, according to the present invention, the configuration of the case 100 of the ignition coil for an internal combustion engine 2 was made to be circular, but the present invention is not exclusively restricted to this, and an axial cross-sectional configuration formed in a tubular configuration which is pentagonal, octagonal, or otherwise polygonal is also acceptable.

Still further, according to the present invention, the ignition coil for an internal combustion engine 2 was mounted in a plug hole 4 formed in an engine head cover 3, but the present invention is not exclusively restricted to this, and an ignition coil for an internal combustion engine which is mounted via a bracket or the like installed on an engine head cover is also acceptable.

Although the present invention has been fully described in connection with the preferred embodiment thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. An ignition coil for an internal combustion engine, said coil comprising:

a case;

a coil portion disposed within said case; and insulating oil at least partially filling said case to immerse said coil portion;

wherein said insulating oil has a flash point of at least 180° C.; a total acid number of oxidation stability of not more than 0.6 mgKOH/g; a pour point of not more than −20° C., said insulating oil being free of cloudiness before said temperature is reached; a dielectric strength of at least 70 kV; and a kinematic viscosity of not less than 20 cSt and not more than 180 cSt at 40° C.

2. The coil of claim 1, wherein said flash point is at least 200° C.

3. The coil of claim 1, wherein said total acid number of oxidation stability is not more than 0.2 mgKOH/g.

4. The coil of claim 3, wherein said total acid number of oxidation stability is not more than 0.1 mgKOH/g.

5. The coil of claim 1, wherein said pour point is not more than −40° C.

6. The coil of claim 1, wherein said kinematic viscosity is at least 50 cSt.

7. The coil of claim 6, wherein said kinematic viscosity is at least 100 cSt.

8. The coil of claim 7, wherein said kinematic viscosity is not more than 130 cSt.

9. The coil of claim 1, wherein said kinematic viscosity is at least 4 cSt at 100° C.

10. The coil of claim 9, wherein said kinematic viscosity is at least 10 cSt at 100° C.

11. The coil of claim 1, wherein said insulating oil partially fills said case to provide a gas chamber therein.

12. The coil of claim 11, wherein said kinematic viscosity is at least 4 cSt at 100° C.

13. The coil of claim 12, wherein said kinematic viscosity is at least 10 cSt at 100° C.

14. The coil of claim 13, wherein said kinematic viscosity is at least 100 cSt at 40° C.

15. The coil of claim 13, wherein said case has a wall made of a single resin layer.

16. The coil of claim 15, wherein said flash point is at least 200° C.

17. The coil of claim 16, wherein:

said case has a substantially tubular shape with an outer diameter of not more than 30 mm;

said coil portion is coaxial with said case; and said case is for insertion into a spark plug hole of an internal combustion engine.

18. An ignition coil for an internal combustion engine comprising:

a tubular case having a first end for accepting a head of a spark plug, and connecting means for connecting said spark plug head to said case;

a coil portion disposed within said case; and insulating oil partially filling said case to immerse said coil portion and provide a gas chamber at an end of said case;

wherein said insulating oil has a flash point of at least 200° C.; a total acid number of oxidation stability of not more than 0.2 mgKOH/g; a pour point of not more than −20° C., said insulating oil being free of cloudiness before said temperature is reached; a dielectric strength of at least 70 kv; and a kinematic viscosity of not less than 20 cSt and not more than 180 cSt at 40° C. and not less than 4 cSt at 100° C.

19. The coil of claim 18, wherein said kinematic viscosity is at least 10 cSt at 100° C.

20. The coil of claim 19, wherein said kinematic viscosity is at least 100 cSt at 40° C.

* * * * *